United States Patent [19]

Nagatsuna

[11] Patent Number: 4,876,572

[45] Date of Patent: Oct. 24, 1989

[54] IMAGE RECORDING HAVING A REMOVABLE IMAGE FORMING CASE

[75] Inventor: Shinji Nagatsuna, Tokyo, Japan

[73] Assignee: Ricoh Company, Ltd., Tokyo, Japan

[21] Appl. No.: 244,354

[22] Filed: Sep. 15, 1988

[30] Foreign Application Priority Data

Sep. 16, 1987 [JP] Japan ..... 62-141370[U]

[51] Int. Cl.[4] ..... G03G 15/00H

[52] U.S. Cl. ..... 355/210; 355/200

[58] Field of Search ..... 355/210, 200, 245, 133

[56] References Cited

U.S. PATENT DOCUMENTS 4,538,896 9/1985 Tajima et al. ..... 355/200

FOREIGN PATENT DOCUMENTS 60-143360 7/1985 Japan ..... 355/210

*Primary Examiner*—R. L. Moses

*Attorney, Agent, or Firm*—Oblon, Spivak, McClelland, Maier & Neustadt

[57] ABSTRACT

An electrophotographic copier, laser printer, facsimile apparatus or similar image recorder includes an image forming case in which a photoconductive element, a developing device and a cleaning device are individually detachably accommodated. The image forming case is removable mounted on a body of the image recorder which is constituted by an upper unit and a lower unit, the case being disposed between the upper and lower units. The photoconductive element, developing device and cleaning device are pressed from above by the upper unit to be positioned with accuracy in individual positioning portions which are provided on the lower unit.

4 Claims, 2 Drawing Sheets

IMAGE RECORDING HAVING A REMOVABLE IMAGE FORMING CASE

BACKGROUND OF THE INVENTION

The present invention relates to an image recorder having a removable image forming case in which a photoconductive element serving as an image carrier and various image forming process devices such as a developing device and a cleaning device are detachably accommodated, the process devices surrounding the photoconductive element.

Image recorders such as an electrophotographic copier, laser printer and facsimile apparatus are extensively used today. Recently introduced in the market is an image recorder with which not only the supply of toner, or developer, but also the replacement of a photoconductive element, a cleaning device and the like are managed by a user. In this kind of image recorder mainly designed for personal use, a photoconductive element and various image forming process units such as a developing device and a cleaning device which are disposed around the photoconductive element are provided in a unitary assembly. The individual devices of the unitary assembly may be removed and replaced as needed, e.g., when a predetermined period of time expires, when any of those devices rails, when the developer runs out, or when the cleaning unit is filled with collected toner. Further, such an image recorder is divided into an upper and a lower structural body or unit at and along a paper transport path so that a paper sheet jamming the path may be removed by a user without resorting to a serviceman. This kind of structure is often referred to as a clam-shell structure. More specifically, the upper unit is loaded with predetermined process devices and openable relative to the lower unit which is loaded with other predetermined process devices, facilitating the removal of a jamming paper sheet. An image recorder of the kind described is disclosed in, for example, pending U.S. patent application Ser. No. 07/164,134, filed Mar. 4, 1988.

To further promote efficient operation of an image recorder of the type described, there has been proposed an image recorder having an image forming case which accommodates a photoconductive element, a developing device and a cleaning device removably therein, the casing itself being removably mounted in the image recorder. Supported by a body of the image recorder, the image forming case is positioned relative to the lower unit while being pressed from above by the upper unit. However, it is difficult to maintain the casing in an accurate position due to the limited strength of the casing, the accumulation of tolerances of various parts, the pressure exerted by the upper unit, etc. Any dislocation of the image forming casing effects the positional relationship between the photoconductive element, developing device, cleaning device and other process devices which are accommodated in the casing. For example, there may occur that a developing roller of the developing device fails to make accurate or uniform contact with the photoconductive element, resulting in the irregular distribution of image density and the wear of the photoconductive element.

SUMMARY OF THE INVENTION

It is therefore an object of the present invention to provide an image recorder which allows a photoconductive element, developing device, cleaning device and other process units that are stored in an image forming case to be positioned with accuracy in a lower unit of the recorder when they are mounted and dismounted for replacement.

It is another object of the present invention to provide a generally improved image recorder having a removable image forming case.

In accordance with the present invention, in an image recorder having a body which is divided into an upper and a lower unit being openable relative to each other, and an image forming case which is disposed between the upper and lower units and accommodates a photoconductive element, a developing device and a cleaning device detachably therein, the lower unit comprises positioning means for positioning the photoconductive element, developing device and cleaning device individually, and the upper unit comprises pressing means for pressing the photoconductive element, developing device and cleaning unit against the lower unit so that the photoconductive element, developing device and cleaning device are positioned by the positioning means.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
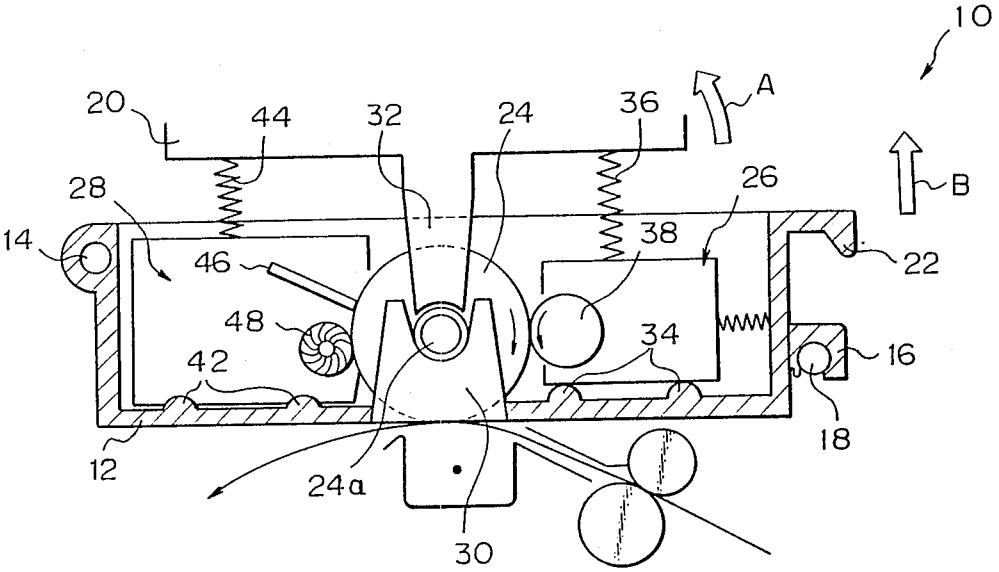
Fig. 1 PRIOR ART
FIG. 1 is a fragmentary section of a prior art image recorder.

To better understand the present invention, a brief reference will be made to a prior art image recorder in the form of an electrophotographic copier or a laser printer, for example, shown in FIG. 1. The prior art image recorder, generally 10, includes an image forming case 12 one end of which is rotatably or openably mounted on a body of the image recorder 10 through a shaft 14. The other end of the case 12 is formed with a hook 16 which is engageable wit a locking shaft 18 which is mounted on a lower structural body or lower unit (not shown) of the recorder body, so that the case 12 may be positioned relative to the lower unit and held in a closed position. After an upper structural body or upper unit 20 of the recorder body has been opened in a direction indicated by an arrow A, the image forming case 12 may be opened as indicated by an arrow B by holding a grip 22.

A photoconductive element in the form of a drum 24, a developing device 26 and a cleaning device 28 are individually removably disposed in the image forming case 12. A shaft 24a supporting the drum 24 therein is received in a bearing portion 30 which is provided in the image forming case 12, while being pressed from above by an arm 32 which extends from the upper unit 20. In this condition, the drum 24 is positioned relative to the image forming case 12. The developing device 26 is positioned relative to the image forming case 12 by being laid on lugs 34 which are provided on the bottom of the case 12 and being pressed downward by a spring 36 which is anchored to the upper unit 20. Further, the developing device 26 is constantly biased toward the drum 24 by a spring 40 which is disposed in the image forming case 12, so that a developing roller 38 of the device 26 may be pressed against the drum 24. Likewise, the cleaning device 28 is laid on lugs 42 which are provided on the bottom of the image forming case 12 and pressed downward by a spring 44 which is anchored to the upper unit 20, whereby the device 29 is positioned relative to the case 12. In FIG. 1, the reference numerals 46 and 48 designate respectively a cleaning blade and a cleaning brush which are included in the cleaning device 28.

As stated above, in the prior art image recorder, the drum 24, developing device 26 and cleaning device 28 are each positioned relative to the lower unit of the recorder body through the image forming case 12. This brings about a problem that an accurate positional relationship cannot be maintained with ease due to the limited strength of the image forming case 12, accumulation of tolerances, pressure exerted by the upper unit, etc, as previously discussed. Especially, in the case of a contact developing system in which the developing roller 38 makes contact with the drum 24, a uniform pressing force is required of the developing roller 38. In this respect, an inaccurate positional relationship would cause incomplete contact of the developing roller 38 with the drum 24 and thereby cause an image to be partly lost, disturb the uniform pressure distribution to render the image density irregular, and excessively increase the pressure to thereby aggravate the wear of the drum 24.

Figure 2:
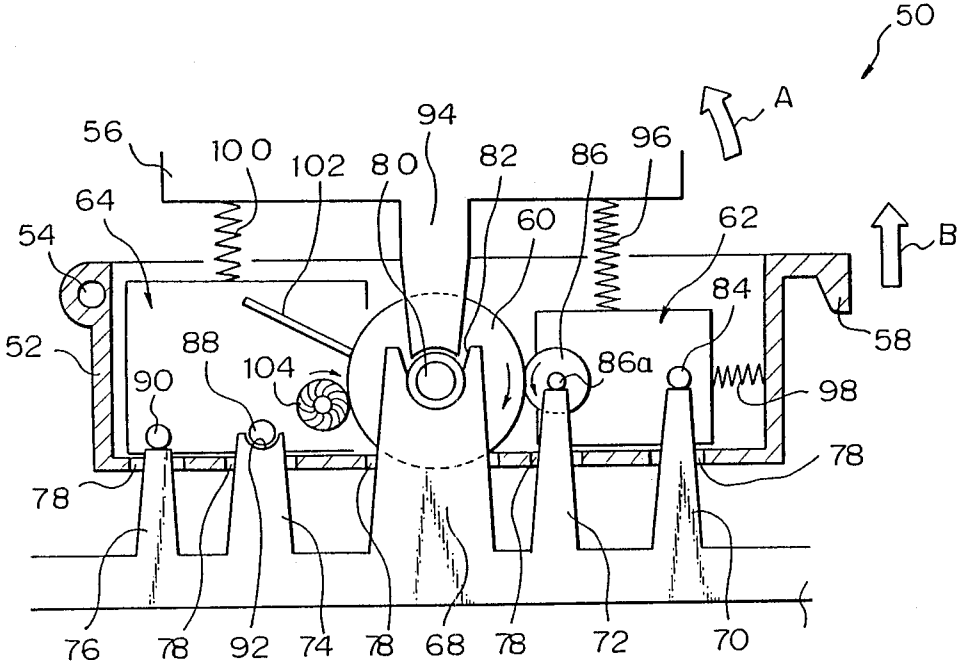
FIG. 2 is a fragmentary section showing an image recorder in accordance with the present invention.

Referring to FIG. 2, an image recorder embodying the present invention is shown which is free from the drawback particular to the prior art as discussed above. While FIG. 2 shows only an essential part of an electrophotographic copier, laser printer or similar image recorder, the rest of the construction is well known in the art and therefore will not be shown or described in detail.

In FIG. 2, the image recorder, generally 50, includes an image forming case 52 which is rotatably or openably mounted at one end thereof on a body of the image recorder 50 through a shaft 54. After an upper structural body or upper unit 56 of the recorder body has been opened as indicated by an arrow A, the image forming case 52 may be opened as indicated by an arrow B by holding a grip 58 which is provided at the other end of the case 52. Detachably accommodated in the image forming case 50 are a photoconductive element in the form of a drum 60, a developing device 62, and a cleaning device 64. While the drum 60 and the devices 62 and 64 is raised integrally with each other when the image forming case 50 is opened, they are positioned relative to a lower structural body or lower unit 66 of the recorder body individually and directly. Specifically, a positioning portion 68 assigned to the drum 60 and bifunctioning as a bearing, positioning portions 70 and 72 assigned to the developing device 62, and positioning portions 74 and 76 assigned to the cleaning device 64 extend upward from the lower unit 66. The positioning portions 68, 70, 72, 74 and 76 are individually penetratable to the interior of the image forming case 50 through openings 78 which are formed though the bottom of the case 50. The positioning portion 68 is provided at its top with a recess 82 for receiving a shaft 80 on which the drum 60 is mounted. The developing device 62 is provided with a reference shaft 84 which is associated with the positioning portion 70. A shaft **86*a* supports a developing roller 86 of the developing device 62 and is associated with the positioning portion 72. The cleaning device 64 is provided with reference shafts 88 and 90 which are associated with the positioning portions 74 and 76, respectively. The positioning portion 74 is formed with a recess 92 at its upper end for receiving the reference shaft 88**.

The drum 60 is positioned directly relative to the lower unit 66 with its shaft 80 being received in the recess 82 of the positioning portion 68 and pressed from above by an arm 94 which extends downward from the upper unit 56. The developing device 62 is also positioned directly relative to the lower unit 66 by having its reference shaft 84 and roller shaft 86a resting on the positioning portions 70 and 72, respectively, and being urged downward by a spring 96 which is anchored to the upper unit 56. Further, the developing device 62 is held in pressing contact with the drum 60 by a spring 98 which is disposed in the image forming case 52. The cleaning device 54 is positioned directly relative to the lower unit 66 by having its reference shafts 88 and 90 resting on the positioning portions 74 and 76, respectively, and being urged downward by a spring 100 which is retained by the upper unit 56.

In FIG. 2, the reference numerals 102 and 104 designate respectively a cleaning blade and a cleaning brush which are included in the cleaning device 54. The positioning portions 68,70, 72, 74 and 76 may be molded integrally with the lower unit 66 by using plastic or may alternatively be implemented as plate members which are securely connected to the lower unit 66. Needless to mention, the coactive positioning members shown and described are also provided at the other side of the image recorder 50 with respect to a direction perpendicular to the sheet surface of FIG. 2.

In summary, it will be seen that the present invention provides an image recorder having an image forming case which accommodates a photoconductive element, a developing device, a cleaning device and similar image forming process devices is bodily openable to facilitate the removal of a jamming sheet. In addition, those process devices are positioned relative to a lower unit of the recorder body individually and directly and, therefore, with accuracy. This eliminates local omission of an image due to incomplete contact of a developing roller of the developing device with the photoconductive element, irregular image density due to irregular contact pressure, and wear of the photoconductive element due to excessive contact pressure.

Various modifications will become possible for those skilled in the art after receiving the teachings of the present disclosure without departing from the scope thereof.

What is claimed is:

1. In an image recorder having a body which is divided into an upper and a lower unit being openable relative to each other, and an image forming case which is disposed between said upper and lower units and accommodates a photoconductive element, a developing device and a cleaning device detachably therein, the improvement wherein said lower unit comprises positioning means for positioning said photoconductive element, said developing device and said cleaning device individually, and said upper unit comprises pressing means for pressing said photoconductive element, said developing device and said cleaning unit against said lower unit so that said photoconductive element, said developing device and said cleaning device are positioned by said positioning means.

2. An image recorder as claimed in claim 1, wherein said positioning means comprises projections which extend upward from said lower unit in association with said photoconductive element, said developing device and said cleaning device respectively.

3. An image recorder as claimed in claim 2, wherein said photoconductive element comprises a shaft which is supported by one of said projections which is associated with said photoconductive element, said developing device comprises a reference shaft supported by one of said projections which is associated with said developing device, and said cleaning device comprises a reference shaft supported by one of said projections which is associated with said cleaning device.

4. An image recorder as claimed in claim 3, wherein said pressing means comprises an arm extending from said upper unit to press said shaft of said photoconductive element.

* * * * *